US005489152A

United States Patent [19]

Rumph

[11] Patent Number: 5,489,152

[45] Date of Patent: Feb. 6, 1996

[54] HAZARDOUS WASTE TRANSPORTATION AND DISPOSAL

[75] Inventor: Robert M. Rumph, Sumter, S.C.

[73] Assignee: The Maitland Company, Sumter, S.C.

[21] Appl. No.: 944,785

[22] Filed: Sep. 15, 1992

Related U.S. Application Data

[63] Continuation-in-part of Ser. No. 939,424, Sep. 4, 1992, Pat. No. 5,275,487, which is a continuation of Ser. No. 622,104, Dec. 4, 1990, abandoned.

[51] Int. Cl.[6] ..... B01F 7/04

[52] U.S. Cl. ..... 366/311; 366/325.92; 366/326.1

[58] Field of Search ..... 366/61, 276, 285, 366/290, 292, 293, 308, 309, 312, 313, 325, 326, 601, 311, 325.92, 326.1; 277/93 R

[56] References Cited

U.S. PATENT DOCUMENTS

| | | | |
|---|---|---|---|
| 155,212 | 9/1874 | White . | |
| 429,484 | 6/1890 | Schillinger . | |
| 912,125 | 2/1909 | Hassam . | |
| 1,276,383 | 8/1918 | Ludekens | 366/293 |
| 1,313,361 | 8/1919 | White . | |
| 1,872,622 | 8/1932 | Donahue . | |
| 1,896,616 | 2/1933 | Gillican . | |
| 1,915,757 | 6/1933 | Pierce . | |
| 1,981,010 | 11/1934 | Torson | 366/601 |
| 2,053,876 | 9/1936 | Pfau | 366/290 |
| 2,108,416 | 2/1938 | Smith et al. . | |
| 2,128,873 | 8/1938 | Roberts . | |
| 2,322,720 | 6/1943 | Scott et al. . | |
| 2,411,138 | 11/1946 | Roberts . | |
| 2,609,185 | 9/1952 | Eisner | 366/285 |
| 2,768,011 | 10/1956 | Mosher | 277/93 |
| 2,872,166 | 2/1959 | Roberts . | |
| 2,891,675 | 6/1959 | Kaplon . | |
| 3,165,300 | 1/1965 | Balistrieri . | |
| 3,211,436 | 10/1965 | Butterfield | 366/67 |
| 3,312,476 | 4/1967 | Eckerle | 277/93 |
| 3,368,723 | 2/1968 | Hardeman | 366/276 |
| 4,023,777 | 5/1977 | Kimmel . | |
| 4,066,224 | 11/1977 | Wilson | 366/169 |
| 4,082,227 | 4/1978 | McGrane et al. . | |
| 4,120,051 | 10/1978 | Lohning | 366/250 |
| 4,157,872 | 6/1979 | Davido, Sr. . | |
| 4,223,622 | 9/1980 | Mazzucato et al. . | |

(List continued on next page.)

FOREIGN PATENT DOCUMENTS

| | | | |
|---|---|---|---|
| 152558 | 7/1953 | Australia | 366/293 |
| 637579 | 4/1962 | Italy . | |
| 149585 | 8/1920 | United Kingdom | 366/292 |
| 784525 | of 1957 | United Kingdom . | |
| 1214810 | 12/1970 | United Kingdom | 366/312 |

OTHER PUBLICATIONS

Industrial Sealing Technology, Hugo Buchter, Jul. 23, 1986, p. 126.

*Primary Examiner*—David Scherbel
*Assistant Examiner*—Randall E. Chin
*Attorney, Agent, or Firm*—Finnegan, Henderson, Farabow, Garrett & Dunner

[57] ABSTRACT

An apparatus for holding hazardous waste made up of solids and liquids during transportation includes a tank made of material selected to be impervious to and non-corrodible by the hazardous waste and having a non-critical portion, an agitator in the tank having fluid agitation portions oriented for rotational movement about a horizontal axis, a non-sparking motor located within the tank connected to the agitator for imparting rotation to the fluid agitation portions, and a power source for the motor outside the tank having means passing through the non-critical portion of the tank for transmitting power from the power source to the motor. Thus, the power source may transmit power to the non-spark generating motor to impart rotation to the agitator to cause the fluid agitation portions to agitate hazardous waste made up of solids and liquids held in the tank to mix the hazardous waste to a flowable form. Preferably, the tank meets United States Department of Transportation Hazardous Waste transport standard MC 307.

21 Claims, 4 Drawing Sheets

U.S. PATENT DOCUMENTS 4,412,747 11/1983 Moriyama .
4,415,164 11/1983 Johnson ..... 277/81 R
4,416,545 11/1983 Krimmel ..... 366/61
4,431,597 2/1984 Cramer ..... 366/285
4,464,259 8/1984 Cramer et al. .
4,542,992 9/1985 Markhart .
4,552,460 11/1985 Wallace .
4,571,091 2/1986 Pardo ..... 366/313
4,599,004 7/1986 Keith .
4,660,987 4/1987 Robinson ..... 366/285
4,671,872 6/1987 Cramer ..... 366/285
4,786,001 11/1988 Ephraim ..... 366/293
4,944,600 7/1990 McKelvey .
4,989,504 2/1991 Jay ..... 366/325
5,094,540 3/1992 Face, Jr. ..... 366/64

HAZARDOUS WASTE TRANSPORTATION AND DISPOSAL

CROSS-REFERENCE TO RELATED APPLICATION

This application is a continuation-in-part of Ser. No. 07/939,424, filed on Sep. 4, 1992, (now U.S. Pat. No. 5,275,487) which in turn is a continuation of U.S. application Ser. No. 07/622,104, filed Dec. 4, 1990, (now abandoned) which are relied upon and disclosures which are incorporated herein by reference.

BACKGROUND OF THE INVENTION

The present invention relates to a method and apparatus for the transportation of hazardous wastes in which the hazardous waste includes both solid and liquid components mixed together. The invention provides for thorough mixing of the solid and liquid components with numerous pertinent advantages.

As people and companies become more and more attuned to the appropriate disposition of hazardous waste, whether by personal desire or government regulation, the need arises for finding suitable ways of handling these wastes, so that the disposition can be effectuated safely and economically.

A particular class of hazardous waste has a high volatility and combustibility, making it dangerous to handle but useful as a fuel. An example of this type of waste is generated by the painting process. Leftover paints, paint thinners, paint solvents, and paint cleaning compositions are mixed together to yield a mixture which has these characteristics and which is toxic when released to the environment. An industry has arisen to use these paint-related wastes as fuel in industrial burners, most particularly in cement kilns. The kilns burn the solid and liquid waste as part of the burner fuel, and the ash residue of the combustion process serves as clinker in the cement. The high temperature in the kiln safely decomposes the various components of the paint-related residue to benign discharges. In addition, many of the solvent components of the waste are recyclable by removal from the waste by distillation. This reduces the volume of the waste, but increases the proportion of solids.

However, the kilns involved are located at some distance from the origin of the waste or the place of distillation, so a need arises to transport the waste to the kiln. Since the waste is highly combustible, transportation of the waste, by United States Department of Transportation regulations, must be in tank trucks having special construction. The applicable standard is Department of Transportation Hazardous Waste MC 307 and MC 312, which includes requiring that the empty tank not leak when subjected to an air pressure of 1.76 kilograms per square meter, so that the structural integrity of the tank must be substantial. Any breach of the wall of the tank requires retesting of the tank to its MC 307 rating. The entire text of the Department of Transportation MC 307 standard is incorporated herein by reference.

At the completion of the trip to the kiln, the discharge of the hazardous waste from the tank to the kiln burner or a holding tank at the kiln has previously been problematic. The liquid successfully drains from the tank, but a large quantity of the solids remain. Previous attempts to deal with this problem include providing drop centers or drop bellies in the tanks so that the bottom wall of the tank is sloping, and gravity assists in the discharge of solids along with the liquids. This design has met with only limited success.

The retention of solids in the bottom of the tank poses numerous disadvantages. First, the backhaul of the tank to pick up another load entails hauling the solids back to the pickup point, making the tank heavier and wasting fuel. Of course, the buildup of the solids reduces the capacity of the tank so that each subsequent refill of the tank includes less and less volume. Typically, two inches of solids were deposited in the bottom of the tank from each load prior to the use of the present invention.

Also, the solids have a high BTU level, so that they contribute to the fuel value of the hazardous waste when they are adequately discharged with the liquid. For them to remain deposited in the bottom of the tank diminishes the available fuel value of the waste.

Moreover, the proper operation of the kiln requires the proper mix of components in the hazardous waste when used as a fuel, including maximum allowable levels of chloride and water, and other components. Not only are the solids capable of precipitating from the mixture, but some of the liquids in the mixture are not entirely miscible. These liquids can separate, causing the liquid as discharged from the tank to have different fuel values, depending on which portion of the tank is being drained at any given time. This can be disruptive to proper operation of the kiln or proper complete combustion of the waste so that the kiln's discharges fall outside of permissible or desired ranges. As a result, the kiln operator tests each load of waste and sometimes turns away a load found not to meet its specifications.

Some such tests have been erroneous in that only a certain fraction of the overall volume of hazardous waste was sampled because of the separation of components. Although the overall mixture in the tank may be within the parameters set by the kiln, the precise sample taken by the kiln tester may fall outside these parameters and result in rejection of the entire truckload.

Typically, the buildup of the solids in the bottom of the tank has been dealt with by having a workman enter the tank with a shovel, to manually transfer the solids into barrels for processing. Such processing, rather than being a useful disposition of the solids as in burning in the kiln, constitutes underground storage or wasteful incineration. This does not, of course, solve the problems of incomplete mixing of liquids and is not a chore the workman typically enjoys. It is known that a previous attempt to agitate the contents of a hazardous waste transport tank included the use of vertically extending augers or the like, but it resulted in a considerable residue of solids in the tank after it was supposedly drained. While other types of tanks in which agitators are provided are known, such as concrete mixers and the like, none are designed for the hauling of hazardous waste under conditions meeting Department of Transportation MC 307 standards.

Thus, the settling of the contents of the tanks has posed numerous problems, which prior art attempts to rectify have not been successful in alleviating. Accordingly, there is a need in the art for a method and apparatus for agitating the hazardous waste solids and liquids to maintain them in or restore them to flowable form so that they may be fully and usefully discharged from the tank.

SUMMARY OF THE INVENTION

The present invention fulfills this need in the art by providing an apparatus for holding hazardous waste made up of solids and liquids in a flowable form including a tank made of material selected to be impervious to and non-corrodible by the hazardous waste and having a non-critical portion, an agitator in the tank having fluid agitation portions oriented for rotational movement about a horizontal axis, a non-sparking motor located within the tank connected to the agitator for imparting rotation to the fluid agitation portions, and a power source for the motor outside the tank having means passing through the non-critical portion of the tank for transmitting power from the power source to the motor. Thus, the power source may supply power to the non-spark generating motor to rotate the agitator to agitate hazardous waste in the tank to maintain or restore same in or to flowable form.

Preferably, the agitator includes support elements for the fluid agitation portions located completely within the tank, and the support elements include bronze bearings in which the fluid agitation portions may rotate. Desirably, the tank has a central horizontal axis, and the horizontal axis about which the fluid agitation portions are oriented is parallel and substantially below the central horizontal axis. The fluid agitation portions include an array of axially extending blades. The blades may extend at a slight angle to the axis of rotation so that upon rotation of the blades, the solids component of the hazardous waste is transported axially.

In an alternative embodiment, the agitator blades are pivotably mounted near the ends of arms radiating from the central axis of the agitator so that in one direction of agitator rotation the blades extend from the radiating arms to increase the effective agitator diameter and/or the effective agitating surface area of the agitator blades. In the other direction of agitator rotation, the blades retract to facilitate an initial breaking up of the solids content of the waste at less required power.

Preferably, the tank meets United States Department of Transportation Hazardous Waste transport standards MC 307 and MC 312. The tank is stainless steel, and the agitator is aluminum. The agitator may also be made of stainless steel or other suitable material.

In one embodiment, the tank has a rear discharge port and the blades transport the solids component to the rear discharge port. In another embodiment the tank has a drop center discharge port and the agitator includes a first set of blades aft of the discharge port and a second set of blades forward of the discharge port. The blades transport the solids components to the center discharge port. In this embodiment, the tank may have a forward floor portion slanted rearwardly forward of the discharge port and an aft floor portion slanted forwardly aft of the discharge port. Desirably, the first set of blades is oriented for rotation about an axis substantially parallel with the aft floor portion, and the second set of blades is oriented for rotation about an axis substantially parallel with the forward floor portion.

The non-sparking motor may be a hydraulic motor, the power source a hydraulic fluid pump, and the means for transmitting power a pair of hydraulic lines. The non-critical portion of the tank is a manway collar, and the hydraulic lines pass through the manway collar.

In one embodiment, the tank is mobile. In this embodiment the apparatus may include a truck or trailer body on which the tank is mounted. Alternatively, it may include a rail car body or a ship, barge or boat on which the tank is mounted.

In another embodiment, which may also be mobile, the tank has a plurality of compartments, and one of the agitators is located in each of the compartments. This permits a plurality of mixtures of hazardous waste to be held in the tank without mixing between the mixtures, but with each mixture held in or restorable to a flowable form.

The invention also provides a method of transporting hazardous waste composed of solids and liquids including the steps of: depositing the hazardous waste in a United States Department of Transportation MC 307 rated tank, moving the tank of hazardous waste to a destination, agitating the hazardous waste to maintain the hazardous waste in substantially completely flowable form without appreciable solids deposition, and discharging the flowable hazardous waste to a suitable repository. The agitation step includes introducing rotational motion to the fluid about a horizontal axis. Desirably, but not necessarily, the agitation step occurs simultaneously with the moving step.

The invention also provides a method of maximizing the available fuel value of a combustible hazardous waste mixture of solids and liquids, each of the solids and liquids being independently combustible, including the steps of: holding the hazardous waste in a tank, agitating the hazardous waste while it is in the tank so that the solids and liquids are in the form of a flowable mixture of independently combustible solids and liquids, and discharging the flowable mixture of independently combustible solids and liquids from the tank to a burner for combustion, whereby both solids and liquids are available to the burner for combustion. In one embodiment this method also includes the step of providing paint residues, paint thinners, paint cleaning solvents or the distillation residue thereof as the combustible hazardous waste. The materials to be hauled may be various, including foods, petroleum distillates, oils and other materials.

BRIEF DESCRIPTION OF THE DRAWINGS

The invention will be better understood from a reading of the following detailed description of the preferred embodiments along with a study of the drawings in which.

DETAILED DESCRIPTION OF HE PREFERRED EMBODIMENTS

Figure 3:
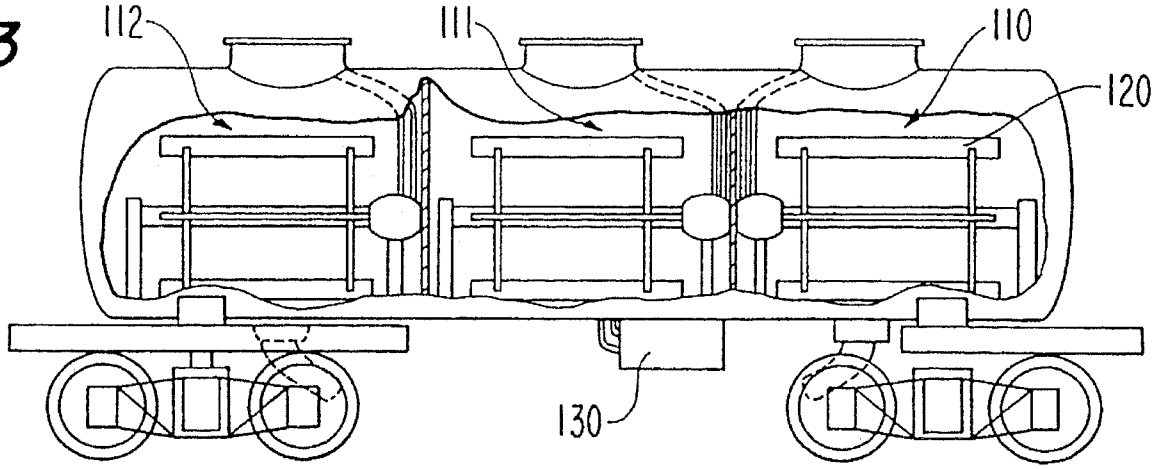
FIG. 3 is a schematic elevational and sectional view of the invention as embodied in a compartmented rail car.

The present invention relates to the agitation of hazardous wastes including solids and liquids to maintain them in flowable form and will be described in detail with reference to a particular trailer configuration as one embodiment. However, as will be appreciated, the invention can be used not only in trailers, but also trucks, rail cars (as in FIG. 3), ships, barges and boats (as in FIG. 4) and even in stationary tanks. In particular, the latter may be particularly valuable for a kiln or other installations where the mixture is to be held until used.

Figure 1:
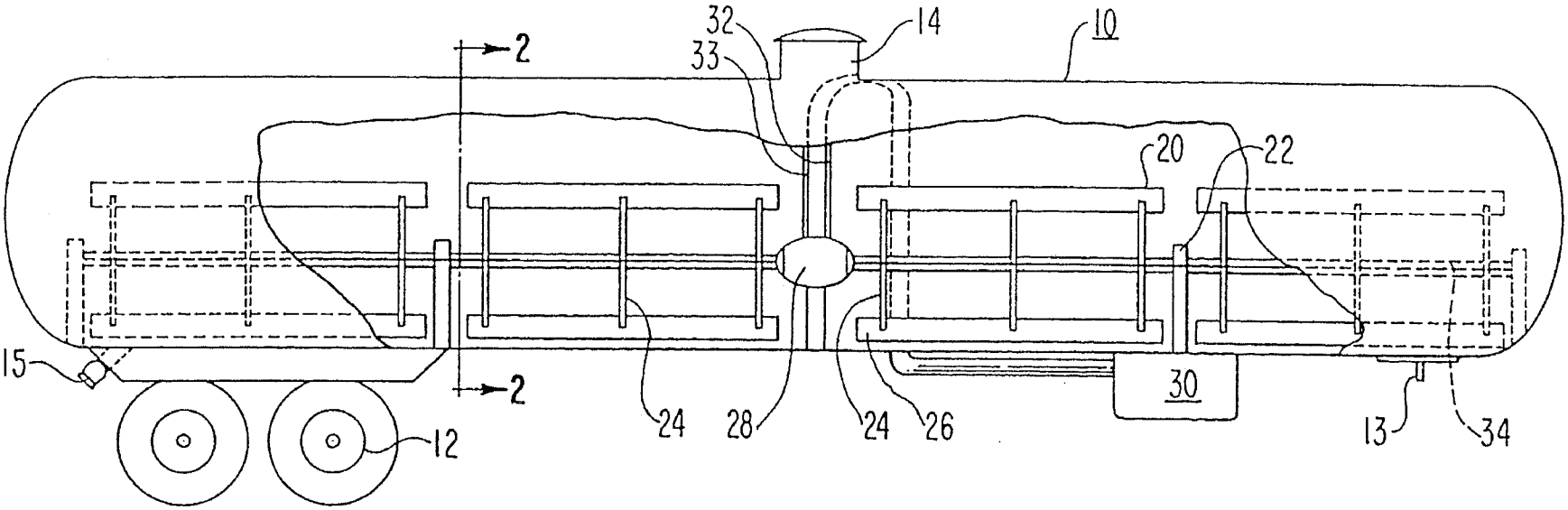
FIG. 1 is a side elevation view of apparatus according to one embodiment of the invention, partially broken away and partially shown in schematic form.

Referring to FIG. 1, a conventional tank trailer has been shown fitted with the invention. The trailer includes a tank 10, an undercarriage with wheels 12, and a pin 13. A manway collar 14 provides a hatchway access to the interior of the tank 10 and a rear discharge 15 is provided, all in conventional fashion. The tank 10 preferably meets the standards of the United States Department of Transportation Standard MC 307 for over-the-road hauling of hazardous waste. As such, it is made of 307 stainless steel, or better.

Disposed within the tank 10 is an agitator 20 which includes supports 22, shaft 34 and blades 26. The supports 22 can be arranged inside the tank in any suitable fashion, with the supports taking the form of posts welded to the floor of the tank as one suitable embodiment. The shaft 34 is arranged to pass through supports 22 in bronze bearings (not shown) and has affixed to it, again by any desired construction, radial arms 24 which in turn have axially extending blades 26 affixed thereto. Preferably, the supports, shafts, radial arms and blades are all made of aluminum to keep the weight of the apparatus as low as possible. In the embodiment shown in FIG. 1, four axially disposed arrays of blades 26 are provided, but other arrangements of blades may be substituted. In particular, with a central manway collar 14 as shown in FIG. 1, one long set of blades can be mounted fore and another aft of the hydraulic motor 28.

In the embodiment depicted in FIG. 1, a single hydraulic motor 28 is provided driving the shaft 34. In a more preferred embodiment, two hydraulic motors are provided, one driving the forward sets of blades and the other driving the rearward sets of blades. This permits the blades to be driven in either the same or opposite directions as may be desired to achieve thorough agitation of the solids and liquids in the tank or to transport the solids and liquids, as will be discussed more later.

A hydraulic power unit 30 is provided on the outside bottom of the tank and includes a 13 horsepower diesel engine driving a hydraulic pump and a hydraulic fluid reservoir. A hydraulic line 32 extends from the hydraulic pump up the outside of tank 10, sealingly passes through the manway collar 14, and extends down inside the tank 10 to the hydraulic motor 28. A similar return line 33 is also provided, similarly located. As will be appreciated, the connection through the manway collar 14 is made to be fluid-tight, but the stresses imposed upon the manway collar are not as great as those on the main body of the tank, so that such breach does not compromise the integrity of the tank for purposes of meeting the Department of Transportation's MC 307 standard. Thus the manway collar is a non-critical portion of the tank. Other tanks may have other non-critical portions.

As can be seen in FIG. 1, the blades are mounted on radial arms 24 so as to clear the bottom of the tank by a comfortable margin, typically about an inch. Even with that much clearance, the turbulence caused by the rotation of the blades prevents any collection of solids on the bottom of the tank. In addition, the spacing provides for the possibility of wear on the bronze bearings over time so that the blades 26 can gradually lower towards the floor without interference.

The environment inside the tank is quite harsh, and the components are subject to wear, particularly the bearings and the seals. While expensive hydraulic motor seals selected for compatibility with the mixture to be hauled may be used if desired, it has been found that such seals are not cost effective. Leakage of hydraulic fluid from the motor 28 inside the tank merely causes the discharge of the hydraulic fluid into the waste material without deleterious effect on either the waste material or the hydraulic system. The fluid loss can be easily detected by loss of fluid from the hydraulic reservoir on the hydraulic power unit 30, and the fluid lost can be easily and inexpensively replaced. In embodiments of the invention in which the motor 28 is operated to maintain the waste material in a flowable state continuously during transportation, there is no danger of waste material entering or fouling the hydraulic system because the pressure difference between the hydraulic line and the waste material prevents passage of waste material into the hydraulic system.

Figure 2:
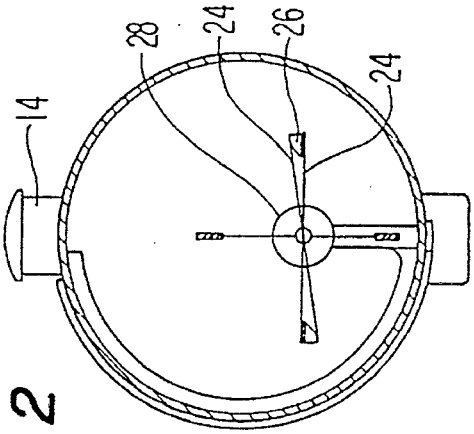
FIG. 2 is a schematic sectional view taken along lines 2—2 in FIG. 1 and looking in the direction of the arrows.

As can be seen in FIG. 2, the blades 26 are inclined to the shaft 34 at a slight angle, typically about 6 degrees. That is, the sets of radial arms 24 are rotated with respect to fore and aft sets of radial arms so that the affixation of the blades 26 to the arms 24 inclines the blades 26. The effect of the angle of the blade is to impart a slight axial as well as rotational motion to the solids, so that the solids are transported axially. This feature can be used to advantage to transport the solids toward the discharge 15 of the tank.

The location of the discharge port on a given tank may indicate the most advantageous arrangement of blades and their angles. The hydraulic motor 28 is typically operable in either direction by reversal of the hydraulic fluid pressure in lines 32, 33 so that the axial transport of solids can be reversed if shaft 34 forming the axis of rotation of the agitator is at a level below the axis of the entire tank. This has been found to provide very good mixing in that the solids and liquids are not only brought up from the bottom of the tank, but sheared into the upper layers, which are, in turn, pulled down by the downward motion of the blades on their return paths.

The mounting of the apparatus including supports, shaft, agitator and motor all entirely within the tank 10 insures that there are no breaches in the structural integrity of the tank 10 other than the unimportant entrances of the hydraulic line through the manway collar 10. This ensures that leakage of the hazardous waste through a failed bearing or seal cannot take place.

In operation, the tank 10 is loaded with the solids and liquid mixture through the manway collar 14. The tank sets off for its destination with the hydraulic power unit 30 turned on, providing hydraulic fluid under pressure through hydraulic lines 32, 33 to drive hydraulic motor 28 and thereby rotate the agitator 20.

As the tank is taken to the kiln, the rotation of the blades 26 gradually causes the solids accumulation to increase towards the rear of the tank, although the entire solids and liquid mixture is kept in a flowable form without appreciable deposit on the floor of tank 10. Upon arrival at the kiln, the tank can remain parked for an extended period of time with the solids and liquids maintained in a flowable form by continued operation of the agitator. This can be helpful if the truck must wait its turn through its rear discharge 15 in conventional fashion, while the agitator 20 continues to run. The tank is completely drained of solids and liquids passing through the discharge 15. If desired, the tank can be pressurized with air pressure applied through manway collar 14 or another fitting to speed up the discharge, but that is not necessary.

Alternatively, the solids and liquids can be deposited into the tank without the agitator in operation, and the solids can be allowed to settle to the bottom. Then, the agitator can be started so the solids and liquids mixture will be fluidized for discharge. If the solids contents is great, it may be necessary to waggle the agitator to and fro to loosen the solids to permit full rotation to begin. Continued rotation thereafter will maintain the solids and liquids in flowable form. An alternative embodiment of the agitator of the invention, intended to facilitate this latter type of operation, is shown in FIGS. 5 and 6.

Figure 5:
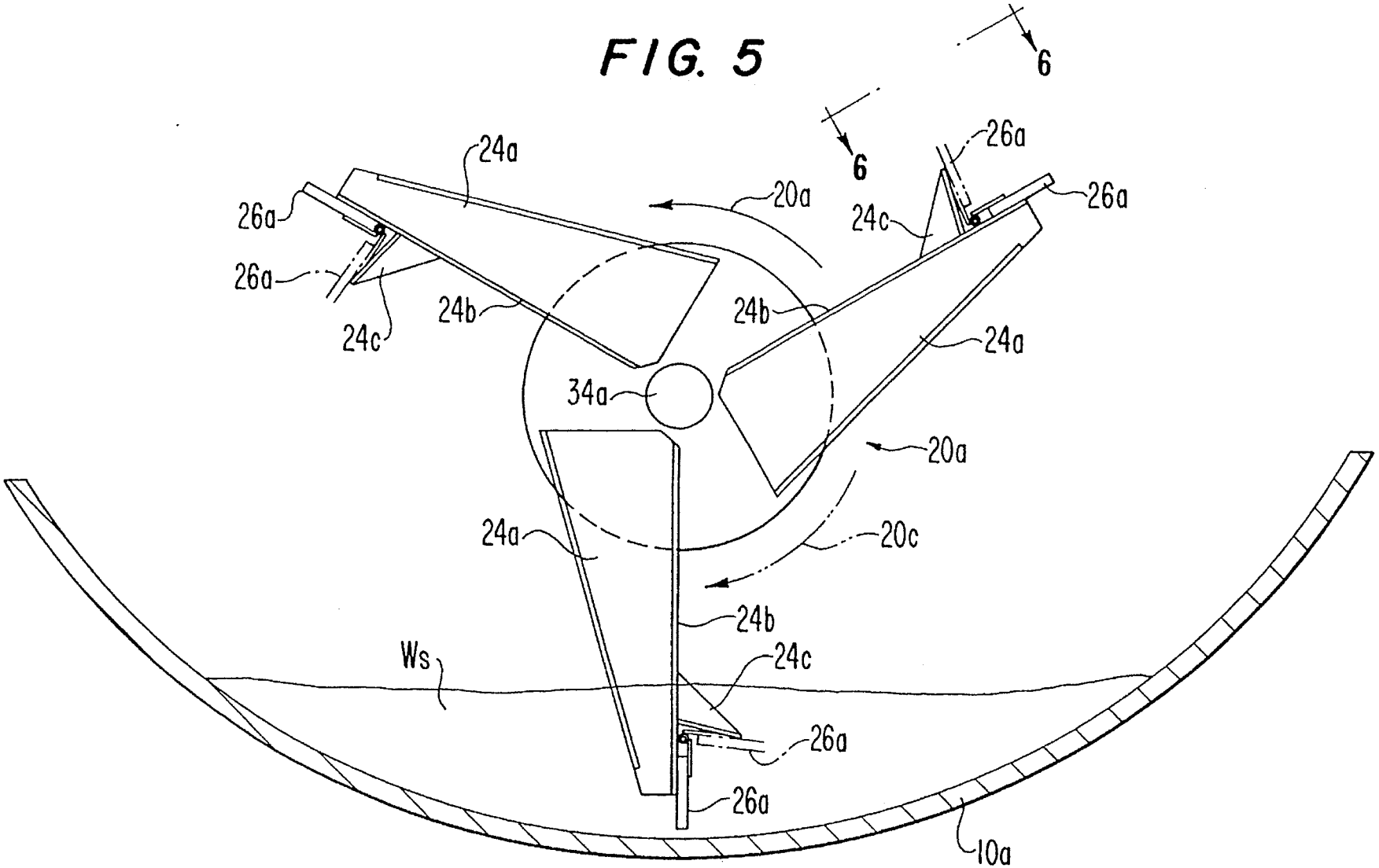
FIG. 5 is a fragmentary transverse cross section illustrating an alternative embodiment of the invention.
Figure 6:
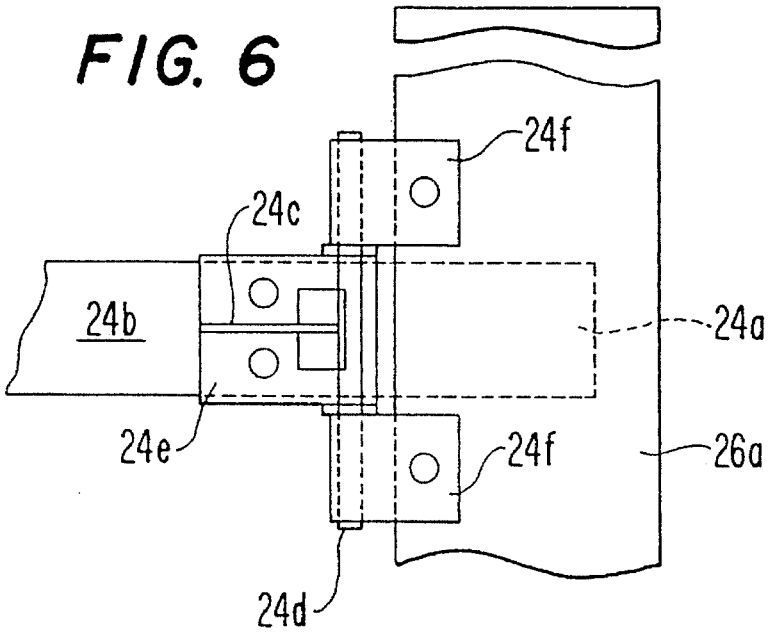
FIG. 6 is an enlarged fragmentary plan view as seen on line 6—6 of FIG. 5.

In FIGS. 5 and 6, functioning parts previously identified are designated by the same reference numerals with an "a" suffix. Thus, an agitator 20*a* is shown in a tank 10*a* and includes three arms 24*a* each having a radial edge 24*b* on a line intersecting the axis of the agitator shaft 34*a*. Longitudinal agitator blades 26*a* are pivotally mounted on the radial edges 24*b* of the arms 24*a* inwardly from the distal end of each arm for movement between an extended position, as shown by solid lines in FIG. 5, and a retracted position shown in phantom lines. Abutment stops 24*c* project from the radial edges 24*b*, inwardly of the blades 26*a*, to establish the retracted blade position. As may be seen in FIG. 5, the abutment stops 24*c* limit the retracted position of the blades 26*a* to an acute angle in relation to the extended position of the blades.

As shown in FIG. 6, the pivotal mounting of the blades 26*a* to the arms 24*a* is effected by hinges, each including a pintle 24*d* secured to the radial edge 24*b* of the respective arms 24*a* by a central hinge plate 24*e*. The pintle 24*d* extends beyond the side edges of the central plate 24*e* to pivotally engage a pair of outboard hinge plates 24*f* fixedly secured to the inner edge of each blade 26*a*.

In the operation of the alternative embodiment illustrated in FIGS. 5 and 6, rotation of the agitator 24*a* in the direction of the solid line arrow 20*b* within the tank 10*a* containing solid waste Ws, will cause the blades 26*a* to pivot to their extended position at which the blades lie against the radial edges 24*b* at the distal ends of the arms 24*a*. In this substance pushing position, the mixing capacity of the agitator 20*a* is maximized by an increased effective diameter of the agitator 20*a*, as well as by an increased blade working surface area due to the radial orientation of the blades 26*a* in the extended position and the working surface availability of the full blade widths. Reversal in the direction of agitator rotation, as represented by the phantom line arrow 20*c* in FIG. 5, will cause the blades 26*a* to pivot to their retracted position against the abutment stops 24*c*. A combination of the angular attitude of the blades 26*a* in this condition, coupled with their reduced effective diameter, will reduce the mixing capacity of the agitator 20*a* to enable an initial mixing of the solid waste Ws with liquid in the tank 10*a* at substantially reduced power. In particular, the angular attitude of the blades reduces the working surface area thereof approximately to that provided by blade thickness and length. The effective diameter of the agitator is reduced because the blades 26*a* pivot about the inner edges thereof in the illustrated embodiment. Both of these factors contribute to a reduction in the power required to rotate the agitator 20*a* when the solids constituent of the waste is densely packed.

After an initial breaking up of the solid waste by agitator rotation in the direction of the arrow 20*c*, the rotation is reversed to the direction of the solid line arrow 20*b* in which the mixing capacity of the agitator is increased to enable thorough mixing of the solids and liquid in the tank 10*a* to a flowable condition.

The ability of the agitator 20*a* to break up and mix the contents of the tank 10*a* to restore the solids and liquids components to a flowable condition enables the agitator 20*a* to be brought into operation after relatively long periods of inactivity. It is contemplated, for example, that during transportation of the waste material, the agitator may remain stationary in the tank 10*a*. Although the solids constituent of the waste becomes tightly packed under vibration incident to transportation, upon arrival at the point of discharging the waste from the tank 10*a*, the agitator 20*a* may be operated first at reduced mixing capacity to break up the solids and then at maximum capacity to mix the solids and liquid to a flowable state. Accordingly, the source of hydraulic power 30 described with reference to FIG. 1, for example, may be omitted from the vehicular structure by which the tank 10*a* is transported. In particular, the source of hydraulic power may be a permanent installation at the site of waste removal from the tank and coupled with the agitator drive motors 28 using conventional fluid hose couplings.

As indicated above, when the fluid motors 28 are continuously operated, hydraulic fluid pressure within the motors 28 would prevent entrance of waste materials into the motor interior, thus eliminating the need for a special motor sealing structure. Where the motors are submerged in the liquid waste for relatively long periods of time without operating, however, external seals are provided in a modified motor 28*a* shown in FIG. 7 of the drawings.

Figure 7:
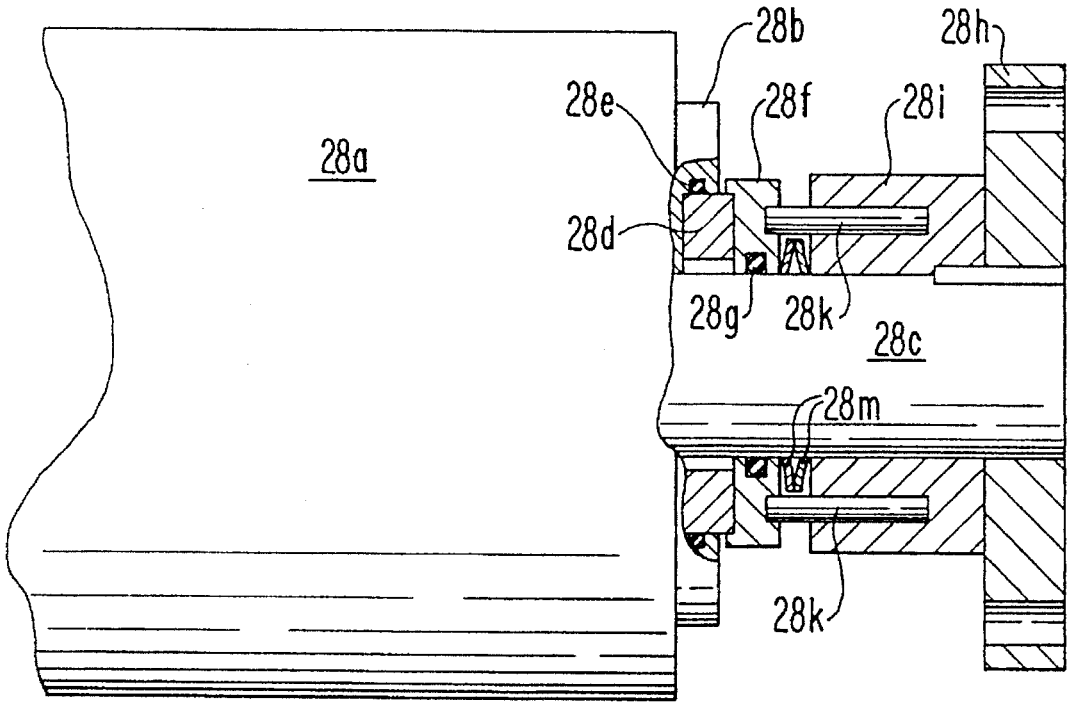
FIG. 7 is fragmentary cross section illustrating a motor sealing construction of the invention.

In FIG. 7, one of two identical ends of the motor 28*a* is shown to include an end frame 28*b* through which one end of the motor shaft 28*c* extends. A stationary seal ring 28*d*, preferably of tungsten carbide, is received in the end frame 28*b* and sealed therewith against fluid passage by an O-ring 28*e*. The stationary seal ring 28*d* is engaged by a running seal ring 28*f*, preferably of silicon carbide, sealed to the shaft 28*c* by an O-ring 28*g*. A coupling 28*h* is keyed to the shaft 28*c*, together with a pin receiving ring 28*i*. Rotation of the running seal ring 28*f* with the ring 28*i* is assured by axial drive pins 28*k*. The running seal ring 28*f* is biassed against the stationary seal ring 28*d* by one or more wave-form annular springs 28*m*. While this type of spring is preferred, it is contemplated that other forms of axial biassing means may be used to ensure that the running seal 28*f* is urged axially against a stationary seal 28*d* at all times.

From the foregoing, it will understood that when the motor 28*a* is dormant or not operating, passage of fluid from the exterior of the motor to the interior thereof is prevented by the seal assembly shown in FIG. 7. When the motor 28 is operated, in the event internal motor pressure exceeds tank pressure, a slight leakage of hydraulic fluid from the motor interior may occur through the seal assembly shown in FIG. 7 in the manner of the embodiment described above with reference to FIG. 1 and to the motor 28.

The apparatus may be installed in level center discharge, drop center or drop belly tanks known to the art. This will assist in assuring movement of the solids and liquids to the center discharge. Preferably, in such a tank, agitators are provided fore and aft of the discharge port. Each is rotatable about an axis of rotation parallel with the floor of the portion of the tank in which the agitator is installed. Thus, the axes of rotation will not be parallel to one another.

In addition, agitators can be provided in known compartmented tanks so that each compartment receives its own mixture and is maintained in a flowable state. This can be seen in the embodiment depicted in FIG. 3 in which the invention is installed in a compartmented rail car. Each compartment 110, 111, 112 is supplied with its own manway collar, agitator 120 and discharge port. A single hydraulic pump 130 may be provided, along with control valves (not shown) suitable for selectively operating the agitators as desired.

Figure 4:
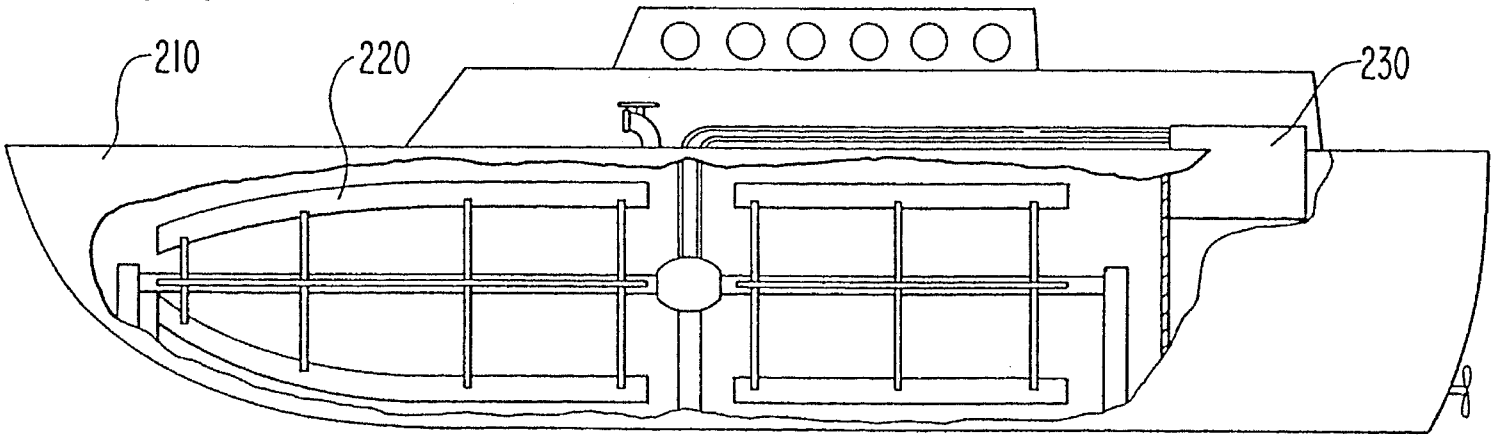
FIG. 4 is a schematic view of the invention as embodied in a boat.

In the embodiment of FIG. 4, the tank 210 is provided with an agitator 220 tapered to conform to the boat hull. The other components including a non-sparking motor and power supply therefor 230 are provided, analogously to those described with reference to FIG. 1.

The thorough mixing that the solids and liquids are given by the present invention not only assures that the tank will be completely drained when desired, but the usefulness of the hazardous waste as a combustible fuel is increased in several ways. First, the effective fuel value of the waste is increased because of the higher BTU content of the solids than the liquids. Since the solids are being more completely discharged and used as the fuel, the effective BTU rating of the fuel increases. Furthermore, since the solids and liquids are mixed together, the liquid when used as a fuel is more homogeneous, so it gives more consistent burning properties and results in more uniform ash, which is distributed in the cement as clinker. Finally, when the kiln operator samples the waste to test it, a more accurate reading of the components of the waste is obtained since it maintained in or restored to a more homogeneous mixture.

Although the invention has been described with respect to specific embodiments, various other applications of the invention will come to those of ordinary skill in the art, and the invention should not be deemed to be limited to the embodiments described herein.

What is claimed is:

1. An apparatus for agitating a substance having solid and liquid constituents, the apparatus comprising;

an elongated tank having a wall defining a tank interior space for containing the substance;

an elongated agitator shaft mounted in the tank, generally extending in an elongated direction of the tank, and having distal ends completely contained within the tank interior space;

means engaging the shaft for rotatably driving the shaft;

at least one agitator blade; and means for connecting said at least one agitator blade to the shaft, the connecting means being configured so that said at least one blade assumes a substance pushing position when the shaft is rotated in a first direction and a retracted position when the shaft is rotated in a second direction opposite the first direction.

2. An apparatus as set forth in claim 1 wherein the tank has a maximum load level and the means for driving the shaft includes a submergible motor located in the tank beneath the maximum load level, the motor having a drive shaft coupled to the agitator shaft.

3. An apparatus as set forth in claim 2 wherein the submergible motor is a fluid motor having sealing means surrounding the motor and sealing the drive shaft of the motor for preventing the substance from entering the motor.

4. The apparatus recited in claim 3 wherein the sealing means includes a pair of radial seal rings urged together by at least one radial wave-form spring.

5. An apparatus as set forth in claim 1 wherein said at least one blade comprises a plurality of blades, each blade being connected to the shaft so that each blade assumes the substance pushing position when the shaft is rotated in the first direction, and each blade assumes the retracted position when the shaft is rotated in the second direction opposite the first direction.

6. An apparatus as set forth in claim 1 wherein the connecting means includes an arm extending from the shaft toward the tank wall, the arm holding an agitator blade adjacent the tank wall.

7. An apparatus as set forth in claim 6 wherein a substantially uniform space exists between an edge of said at least one blade and the wall over substantially the entire length of the blade.

8. An apparatus as set forth in claim 6 wherein the connecting means further includes a hinge connecting the arm to said agitator blade.

9. An apparatus as set forth in claim 6 wherein the connecting means further includes an abutment stop for engaging said agitator blade to limit pivotal movement of the blade in the retracted position.

10. An apparatus as set forth in claim 9 wherein the abutment stop maintains the blade at an acute angle relative to the arm when the blade is in the retracted position.

11. An apparatus as set forth in claim 1 wherein the tank has wheels for rendering the tank mobile.

12. An apparatus for agitating a substance having solid and liquid constituents, the apparatus comprising:

an elongated tank having a wall defining a tank interior space for containing the substance;

an elongated rotatable agitator shaft mounted in the tank interior space and extending in an elongated direction of the tank;

means engaging the shaft for rotatably driving the shaft;

a plurality of arms connected to the shaft and extending toward the tank wall;

at least one elongated agitator blade extending in the elongated direction of the tank and interconnecting said plurality of arms, the at least one blade being mounted on said plurality of arms in a manner permitting the blade to assume a substance pushing position when the shaft is rotated in a first direction, and to assume a retracted position when the shaft is rotated in a second direction, opposite to the first direction.

13. An apparatus as set forth in claim 12 wherein the shaft includes distal ends entirely contained within the tank.

14. An apparatus as set forth in claim 12 wherein the tank includes a maximum load level and the driving means includes a submergible motor located beneath the load level, the motor having a drive shaft coupled to the agitator shaft.

15. An apparatus as set forth in claim 12 wherein the at least one blade is mounted to the arms with a hinge associated with each of said plurality of arms.

16. An apparatus as set forth in claim 15 further including an abutment stop located on each of said plurality of arms for limiting movement of the blade in the retracted position.

17. An apparatus as set forth in claim 16 wherein the abutment stop maintains the blade at an acute angle in the retracted position relative to at least one of said plurality of arms.

18. An apparatus as set forth in claim 12 wherein said at least one blade comprises plurality of blades, each blade being connected to the shaft by at least two of said arms.

19. An apparatus as set forth in claim 12 wherein the driving means includes a fluid motor having sealing means surrounding the motor and sealing a drive shaft of the motor for preventing the substance from entering the motor.

20. The apparatus recited in claim 19 wherein the fluid motor includes a pair of radial seal rings urged together by at least one radial wave-form spring.

21. The apparatus as set forth in claim 12 wherein the tank includes wheels for rendering the tank mobile.

* * * * *

UNITED STATES PATENT AND TRADEMARK OFFICE

CERTIFICATE OF CORRECTION

PATENT NO. : 5,489,152

DATED : February 6, 1996

INVENTOR(S) : Robert M. RUMPH

It is certified that error appears in the above-indentified patent and that said Letters Patent is hereby corrected as shown below:

Claim 18, column 10, line 53, before "plurality" insert --a--.

Signed and Sealed this

Sixteenth Day of April, 1996

Bruce Lehman

*Attest:*

BRUCE LEHMAN

*Attesting Officer*

*Commissioner of Patents and Trademarks*